United States Patent [19]

Matula

[11] Patent Number: 4,537,331

[45] Date of Patent: Aug. 27, 1985

[54] APPARATUS FOR DISPENSING VISCOUS MATERIALS

[76] Inventor: Joseph J. Matula, 114 Sanderson Ave., Winnipeg, Manitoba, Canada, R2R 1R4

[21] Appl. No.: 506,362

[22] Filed: Jun. 21, 1983

[30] Foreign Application Priority Data

Aug. 13, 1982 [CA] Canada ..... 409445

[51] Int. Cl.[3] ..... B67D 5/64; A01C 3/06

[52] U.S. Cl. ..... 222/165; 222/608; 222/561; 222/485; 401/48; 239/140; 239/657

[58] Field of Search ..... 222/609, 608, 164, 165, 222/166, 167, 169, 482, 484, 485, 561, 559, 478; 118/305, 207; 401/48, 139, 137, 140; 239/657, 140, 146, 663

[56] References Cited

U.S. PATENT DOCUMENTS

| | | | |
|---|---|---|---|
| 271,912 | 2/1883 | Peironnet | 239/657 |
| 1,086,795 | 2/1914 | Tarrant | 239/140 |
| 2,373,239 | 4/1945 | Fenn | 222/559 |
| 2,570,426 | 10/1951 | Cassidy | 222/570 |
| 2,837,242 | 6/1958 | McLaughlin | 222/608 |
| 3,087,188 | 4/1963 | Garlock | 401/137 |

FOREIGN PATENT DOCUMENTS

| | | | |
|---|---|---|---|
| 775292 | 3/1966 | Canada | 222/608 |
| 1022326 | 3/1966 | United Kingdom | 222/559 |

*Primary Examiner*—Joseph J. Rolla
*Assistant Examiner*—Andrew Jones
*Attorney, Agent, or Firm*—Stanley G. Ade

[57] ABSTRACT

Conventional dispensers are often crude containers with wheels which dispense asphalt by tipping the container and then spreading same manually or by chains or utilizing a relatively inaccurate feed mechanism within the container. The present device is a wheel mounted container insulated to retain heat and thus maintaining the asphalt or similar material in a fluid condition. Adjustable metering valves control the flow and hence the volume of the material dispensed either in a mopping or glazing mode or in a ribbon mode which is also adjustable for width. The machine can be placed in a filling and transport position supported on two main wheels or can be rotated to a dispensing position supported upon the same two main wheels and a third support wheel which also controls the clearance of the dispensing valves from the floor. When in the filling and transporting position, the mopping and glazing chain assembly engages against a portion of the container wall that is not insulated thus permitting the heat of the material within the container to reach the chain assembly and unfreeze same prior to use.

24 Claims, 9 Drawing Figures

APPARATUS FOR DISPENSING VISCOUS MATERIALS

BACKGROUND OF THE INVENTION

This invention relates to new and useful improvements in apparatus for dispsensing viscous materials particularly bituminous materials such as asphalt or the like.

Asphalt being a particularly viscous material, is difficult to dispense accurately and to spread evenly, particularly when being operated in relatively cold climates.

It is normal to pre-heat the asphalt prior to filling the containers in conventional machines but these often chill rapidly and the dispensing of the material in a relatively even layer becomes extremely difficult if not impossible.

Because of the inaccuracy of conventional machines, estimating the quantity of asphalt required is an extremely difficult function and often the quantity of asphalt used is above the specified requirements which, of course, adds to the cost of the spreading contract leading to loss of profits and the like.

Furthermore, conventional dispensers are relatively crude and slow in operation so that it is normal to utilize many dispensers on a roof or flooring application, all of which adds to the cost of operation.

SUMMARY OF THE INVENTION

The present invention overcomes these disadvantages by providing a device which dispenses asphalt accurately and evenly and which can be adjusted as to quantities.

Another advantage is that the dispensing valve can be adjusted as to quantity and also includes means whereby ribbon dispensing of the various widths can be undertaken.

Furthermore, the container is insulated thus maintaining the heat of the asphalt for a greater period of time, once again leading to efficiency in dispensing and spreading of the asphalt or bituminous materials.

In accordance with the invention there is provided a dispensing apparatus for viscous materials such as asphalt or the like comprising in combination a container, ground engaging wheels one upon each side thereof, at least one handle extending therefrom, said container being rotatable upon said ground engaging wheels through approximately 120°, from a filling and transporting position, to a dispensing position and vice-versa, said container including a filling opening, which, when said container is in the filling and transporting position, is substantially on the upper side thereof, material dispensing means in one wall thereof, a spreader chain assembly on said one wall adjacent said dispensing means and at least one support wheel journalled for rotation upon the upper side of said container when said container is in the filling and transporting position, said support wheel engaging the ground when said container is in said dispensing position, said dispensing means being in a non-dispensing position adjacent the upper side of said container when in said filling and transporting mode and in a dispensing position adjacent the lower side of the container, when said container is in a dispensing position.

Another advantage of the present invention is that it may be rotated through 120° from a filling and transport position to a dispensing position wherein it is supported upon two main wheels and a third support wheel in a triangular formation.

A yet further advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Before proceeding with the description of the invention, it should be stressed that although the present device is designed for use primarily with bituminous viscous materials such as asphalt or the like, nevertheless the claims are not limited to the use of the device with such a material.

Figure 1:
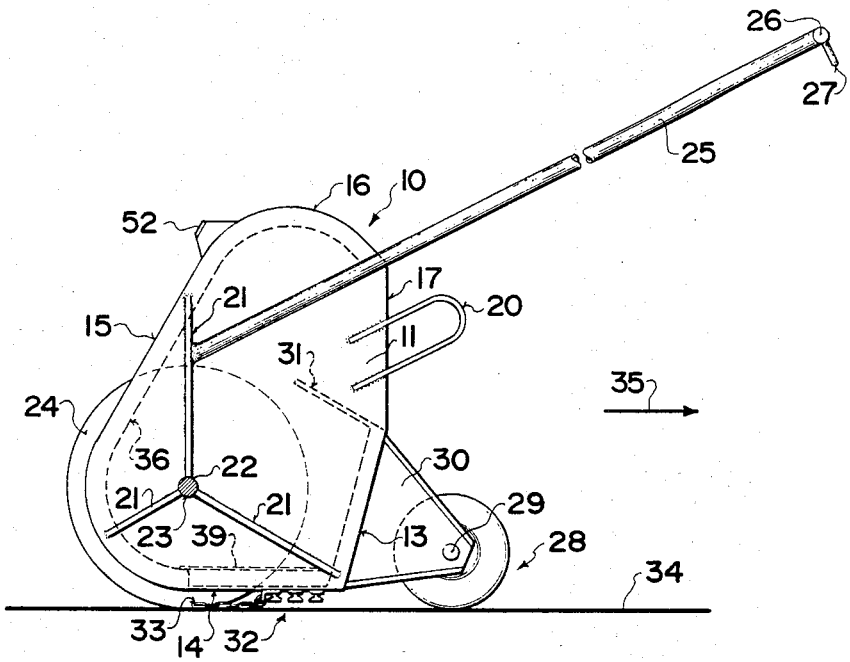
FIG. 1 is an end elevation of the machine in the dispensing position.
Figure 2:
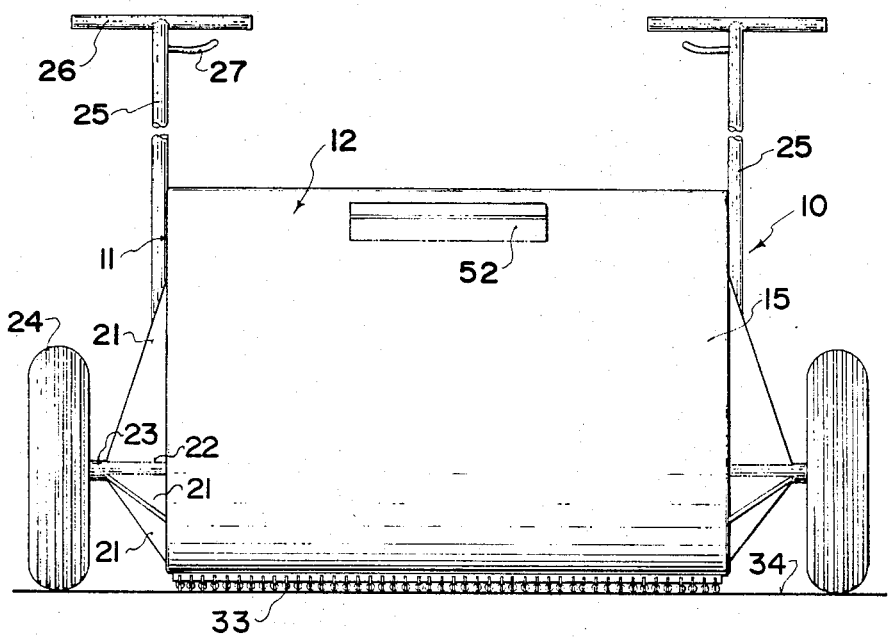
FIG. 2 is a front elevation of FIG. 1.
Figure 3:
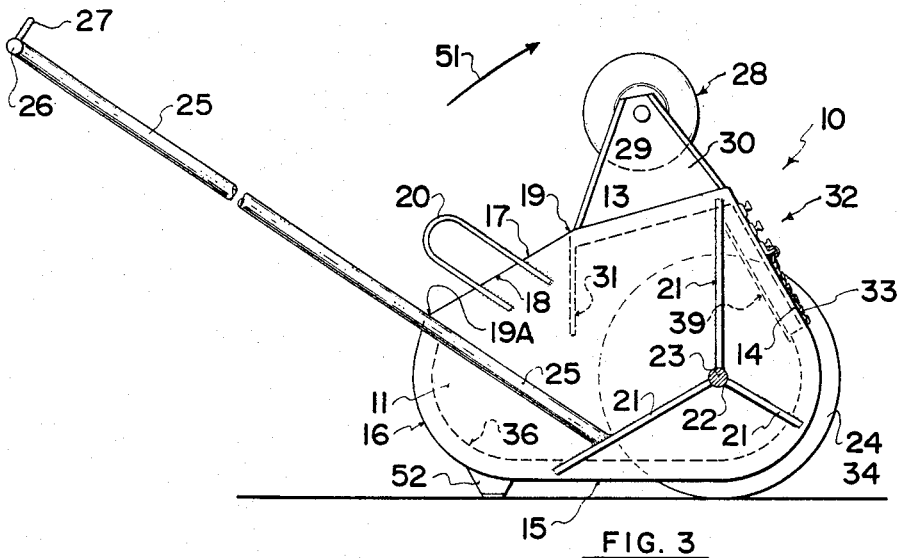
FIG. 3 is a view similar to FIG. 1, but showing the device rotated through approximately 120° to the filling and transport position.
Figure 4:
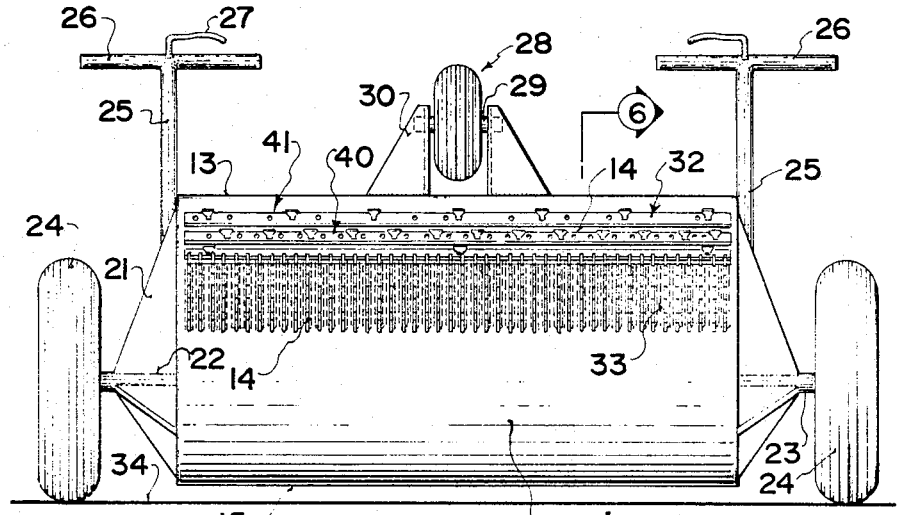
FIG. 4 is a front elevation of FIG. 3.
Figure 5:
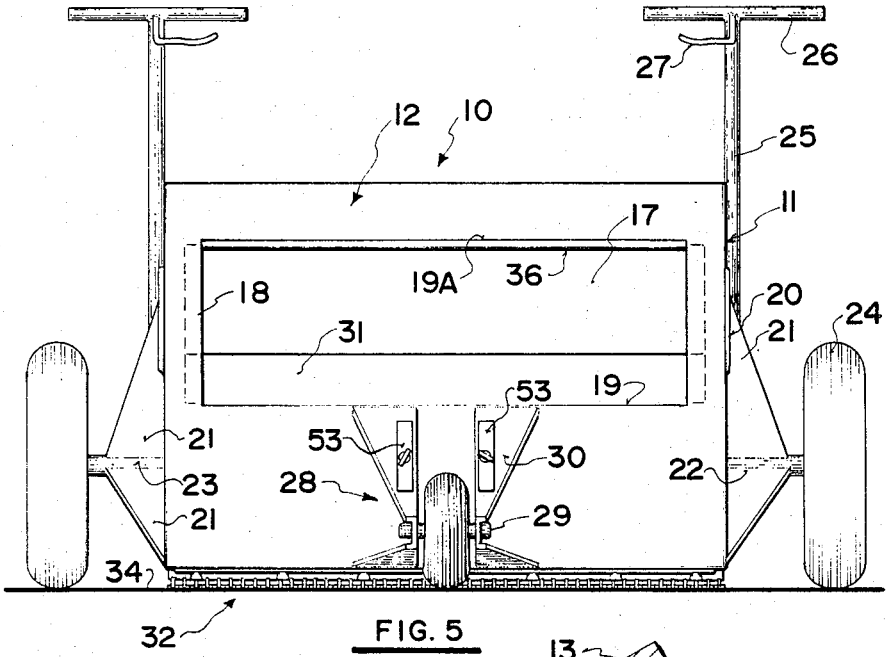
FIG. 5 is a rear elevation of FIG. 1.

Secondly, the drawings and description refer to the machine in one of two positions, a filling and transport position illustrated in FIGS. 3 and 4 and a dispensing position illustrated in FIGS. 1, 2 and 5.

Proceeding therefore to describe the invention in detail, reference character 10 illustrates a container having a pair of end plates or walls 11 enclosing a circumferential or main wall collectively designated 12. When in the filling and transport position illustrated in FIGS. 3 and 4, the circumferential wall includes a substantially horizontal upper wall portion 13, a downwardly and outwardly sloping front wall portion 14, a base wall 15 and a rear wall 16.

A filling opening 17 is defined by the upper edges 18 of the end walls and the rear edge 19 of the upper wall 13 together with the upper edge 19A of the rear wall 16.

A pair of lifting loops 20 are secured one to each of the upper edges 18 of the side walls or end plates 11 and permit the assembly to be lifted by apparatus such as a crane or the like. These loops are positioned so that the handles point upwardly and thereby cannot contact the building which could cause broken windows and/or machine handles.

A plurality of strengthening gusset plates 21 extend from each end wall and converge at an axle support location 22 from which wheel axles 23 extend upon which ground engaging main wheels 24 are journalled for rotation. When in the position illustrated in FIGS. 3 and 4, the container rests upon these main wheels 24 and the base 15 as clearly shown in FIG. 3.

A pair of handles 25 are secured to one of the gusset plates 21 by the lower ends thereof and to the side plates or end walls 11 and extend upwardly and rearwardly therefrom and terminate in cross bars 26. Hooks 27 extend from the handles 25 adjacent the cross bars 26 and support a conventional hand mop (not illustrated) which may be engaged within the opening of the container with the handle engaging the hook 27, when the device is in use.

A support wheel collectively designated 28 is journalled for rotation upon an axle 29 which in turn is supported between wheel support plates 30 extending upwardly in spaced and parallel relationship from one another from the upper wall 13 and when the container is in the filling and transport position illustrated in FIGS. 3 and 4, this wheel is uppermost as clearly shown. However, when the assembly is rotated through approximately 120° to the position illustrated in FIGS. 1, 2 and 5, this wheel engages the ground as clearly shown in FIG. 1 and is also still supported by the main wheels 24 so that a triangular support configuration is provided with the positioning of the wheel giving the correct clearance for the dispensing of material as will hereinafter be described.

It should also be noted that a baffle 31 extends diagonally across part of the opening 17 from the rear edge 19 of the upper panel 13 and prevents material from spilling out of the opening as the machine is rotated from one position to the other. The lower or distal edge also acts as a safe filling weight gauge.

The front wall (which becomes part of the base together with the upper wall 13 when the device is in the dispensing position) includes the dispensing valve assembly collectively designated 32 and a chain mesh panel or assembly 33 is secured by one edge thereof, across the front wall immediately adjacent to these dispensing valve assemblies. When in the position shown in FIGS. 3 and 4, the valves are situated immediately above the chain mesh assembly 33 which in turn is secured to the front wall by the upper edge thereof so that when the device is rotated to the position shown in FIGS. 1, 2 and 5, the chain mesh curtain or assembly swings downwardly slightly and engages the floor surface indicated by the line 34. As the machine is moved by the handle 25, in the direction of arrow 35, material is spread through one or the other of the dispensing valve assemblies and is spread by the chain curtain immediately therebehind.

An important feature of the device is the fact that all of the walls including the end wall 11 are insulated with the exception of the portion of the front wall 14 carrying the dispensing valve assemblies 32 and the area underneath the chain curtain assembly 33. This is provided by spaced apart inner shells 36 and outer shells 37 with insulation 38 being situated therebetween.

When in the filling and transport position (see specifically FIG. 6), the chain curtain lies against the outer surface of the front wall 14 so that heat from the hot asphalt carried thereby, passes through this single wall portion of the front wall and heats the chain curtain thus unfreezing same and making the curtain pliable and clear of asphaltic material from the last use so that when it is moved to the dispensing position, the chain curtain is immediately ready for use in contrast to conventional spreading chain assemblies which do not contact the hot tank and therefore freeze even under summer conditions. Furthermore, this allows a much finer chain mesh to be used for the spreading action rather than the relatively coarse lengths of chain conventionally used and which do not spread asphalt efficiently and evenly.

Figure 6:
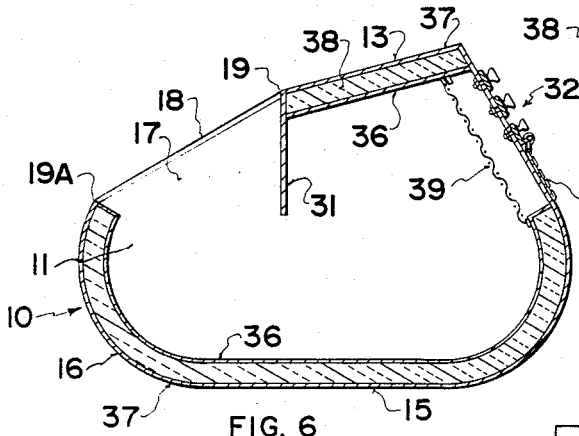
FIG. 6 is a cross sectional view through FIG. 4 substantially along the line 6—6 thereof.
Figure 9:
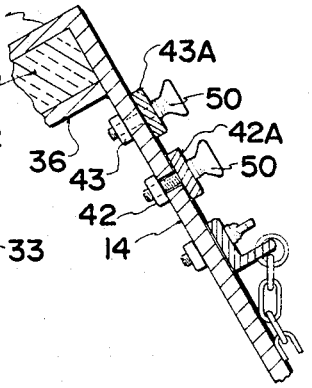
FIG. 9 is a fragmentary section substantially along the line 9—9 of FIG. 8.

The sloping position of the front wall 14, when in the filling and transport position, permit the chain to engage the wall surface as well as permitting any debris to fall from an inner screen or filter 39 which spans the inner surface of the front wall 14 particularly adjacent the dispensing valve assembly 32. This screen is shown in FIG. 6 and is of a mesh sufficient to screen unwanted debris which may be contained within the asphalt or other material being dispensed by the apparatus. Such debris may then be mopped out by the hand mop (not illustrated) after the container is empty.

The dispensing valve assemblies collectively designated 32 include a transversely extending main dispensing gate valve assembly collectively designated 40 and a transversely extending ribbon gate valve assembly collectively designated 41 and situated adjacent and parallel to the main gate valve assembly 40 and just above same with reference to FIGS. 3, 4 and 6.

Figure 7:
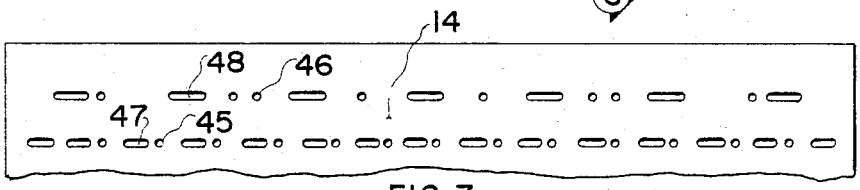
FIG. 7 is an enlarged fragmentary view of the front wall of the container showing the apertures therethrough for the control valves.

Each gate valve assembly includes an inner gate valve plate 42 and 43 respectively and a corresponding outer gate valve plate 42A and 43A respectively. These extend transversely over a plurality of dispensing apertures 45 and 46 respectively, formed through the front wall 14 and extending from side to side, together with a plurality of elongated apertures 47 and 48 respectively, also formed through the front wall as clearly shown in FIG. 7.

Similar apertures 49 and 50 are formed through the gate valve plates 42, 42A and 43, 43A with the plates engaging over the portions of the front wall 14 which are apertured as hereinbefore described and a plurality of adjusting and tightening bolt assemblies in the form of wing bolts 50 engage through the outer plates 42A and 43A, through the elongated slots 47 and 48 and into screw threaded apertures in the inner plates 42 and 43. This allows the inner and outer plates to be end shifted through the limits of the closed ended elongated slots 48 thus adjusting the relationship between the apertures 49 and 50A in the plates with the apertures 45 and 46 in the front wall.

Figure 8:
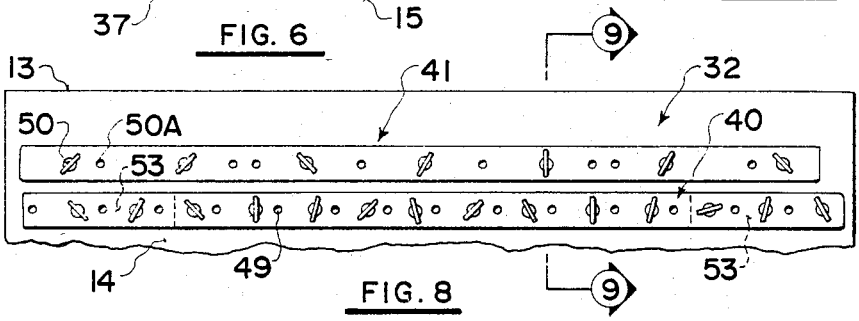
FIG. 8 is a view similar to FIG. 7, but showing the control valve plates in position.

The tightening or securing bolts 50 extend through elongated apertures or slots and can be loosened if sediment from hot asphalt tends to cake the valve plates making them immovable. This allows the valve plates to be loosened for readjustment. These thumbscrews 50 can then be tightened after adjustment to prevent inadvertent movement of the valve assembly. Also note should be taken of the pair of identical end covers or blanking plates 53 shown in phantom in FIG. 8 and which may be selectively secured over the ends of the valve plates to allow 30" or 24" spread of asphalt as desired from the main gate valve. These may be stored by attachment to the device one upon each side of wheel 28 as shown in FIG. 5.

The spacing of the dispensing apertures 45 permits full discharge of the material when these apertures are aligned with the corresponding apertures 49 in the plates 42 and 42A and include means to completely close off these apertures when not in use.

The apertures 50A within strips 43, 43A, may be aligned or misaligned with apertures 46 within the front wall and may be used to dispense ribbons of material to various spacing. Once again, these can be completely misaligned so as to shut off any dispensing through the ribbon gate valve assembly 41.

In operation, the device is positioned as shown in FIGS. 1, 2 and 6 whereupon asphalt at a temperature of approximately 450° F. is poured through the opening 17 and into the container.

The required gate valve 40 or 41 is opened and adjusted to dispense the correct amount of asphalt in the case of gate valve 40 or the desired spacing of asphalt ribbons in the case of gate valve 41.

The machine is then rotated from the position shown in FIG. 3 to the position shown in FIG. 1 in the direction of arrow 51 and is then moved by handles 25, in the direction of arrow 35. This causes the dispensing of asphalt which is then spread by the chain screen or curtain 33. It should be noted that if ribbon asphalt is being dispensed through gate valve assembly 41, then the chain curtain can be removed.

By controlling the quantity of asphalt being dispensed through the main gate valve assembly 40, the exact amount of asphalt per square foot is readily adjusted.

The device can be used for floor mopping or glazing operations and can spread asphalt with extreme accuracy even in extremely cold weather. The chain mopper is easily removable for dispensing ribbons or gravelling asphalt and it rests against the non-insulated area behind the screen so that as soon as the tank is filled with the hot asphalt, the chain becomes flexible and ready to work.

It should be noted that the support wheel assembly 28 reduces operator fatigue as the machine is completely self-supporting when in the dispensing position. Also, the main wheels are relatively wide so that they cannot fall between deck flutes when asphalting certain roofing applications.

The sandwich style gate control valves 40 and 41 allow more accurate metering and more positive closing and reduce considerably, any tendency of such valves to coke up or seize tight, as loosening the wing bolts again loosens the entire valve mechanism for adjustment. After the desired adjustment is achieved, tightening the screws ensures more positive closing and prevents inadvertent movement thereof.

The material screen 39 prevents debris from clogging the gate valve assemblies and is relatively self-cleaning inasmuch as debris falls back into the container when moved to the filling and dispensing position where it can be taken out by the hand mop. It will also be noted that it is shielded by the baffle so that it cannot become damaged by the use of hand mop which is often used for certain applications.

The machine, due to the adjustable gate valves 40 and 41, may accomplish the following:

1. Floor mopping to the full width of the machine (approximately 36 inches is desirable) with adjustable volume.
2. Glazing to the same width with adjustable volume.
3. Applying ribbons at various spacing such as six inch or eight inch spacing and with adjustable volume.
4. Applying asphalt at a narrower width for gravelling and for fiberboard with adjustable volume.
5. Applying asphalt at full width for gravelling with adjustable volume.
6. The two six inch long strips can both be used, giving a 24 inch spread for applying upon 24 inch wide fiberboard or for dispensing asphalt before a 24 inch gravel spreader is used.
7. Using one six inch long cover strip enables the machine to spread asphalt 30 inches–32 inches wide for adhering 32 inch material to the roof.
8. It also serves as an insulated mop bucket on wheels for certain mop applications Finally, in the preferred embodiment, a small stand 52 is provided on the surface upon which the container rests when in the filling position shown in FIGS. 3 and 4. This is also visible in FIGS. 1 and 2 which show the container in the said filling position.

Since various modifications can be made in my invention as hereinabove described and many apparently widely different embodiments of same made within the spirit and scope of the claims without departing from such spirit and scope, it is intended that all matter contained in the accompanying specification shall be interpreted as illustrative only and not in a limiting sense.

I claim:

1. A dispensing apparatus for viscous materials such as asphalt or the like comprising in combination a container, ground engaging wheels one upon each side thereof, at least one handle extending therefrom, said container being rotatable upon said ground engaging wheels through approximately 120°, from a filling and transporting position, to a dispensing position and vice-versa, said container including a filling opening, which, when said container is in the filling and transporting position, is substantially on the upper side thereof, material dispensing means in one wall thereof, a spreader chain assembly on said one wall adjacent said dispensing means, said spreader chain assembly engaging said one wall when in the filling and transporting position whereby the heat of the viscous material transfers to said spreader chain assembly and engaging the ground when said container is in the dispensing position and at least one support wheel journalled for rotation upon the upper side of said container when said container is in the filling and transporting position, said support wheel engaging the ground when said container is in said dispensing position, said dispensing means being in a non-dispensing position adjacent the upper side of said container when in said filling and transporting mode and in a dispensing position adjacent the lower side of the container, when said container is in a dispensing position.

2. The apparatus according to claim 1 which includes a baffle depending from the front edge of said filler opening and situated substantially vertically when said container is in the filling and transporting position.

3. The apparatus according to claim 1 in which said one wall constitutes a front wall sloping outwardly and downwardly when said container is in the filling and, transporting position, and a filtering screen parallel to and spanning the portion of the front wall in which the dispenser means is located whereby debris trapped thereby when in the dispensing position, falls from said screen when said container is in the filling and transporting position.

4. The apparatus according to claim 2 in which said one wall constitutes a front wall sloping outwardly and downwardly when said container is in the filling and transporting position, and a filtering screen parallel to and spanning the portion of the front wall in which the dispenser means is located whereby debris trapped thereby when in the dispensing position, falls from said screen when said container is in the filling and transporting position.

5. The apparatus according to claim 1 in which said container includes a circumferential wall and a pair of spaced and parallel end walls, said circumferential wall, when said container is in the filling and transporting position, including an upper wall, an outwardly and downwardly sloping front wall and a substantially horizontal base wall, and an upwardly extending rear wall, said filling opening being defined between the rear edge of said upper wall and the upper edge of said rear wall, the walls of the container being insulated to retain the heat of the viscous material carried thereby.

6. The apparatus according to claim 2 in which said container includes a circumferential wall and a pair of spaced and parallel end walls, said circumferential wall, when said container is in the filling and transporting position, including an upper wall, an outwardly and downwardly sloping front wall and a substantially horizontal base wall, and an upwardly extending rear wall, said filling opening being defined between the rear edge of said upper wall and the upper edge of said rear wall, the walls of the container being insulated to retain the heat of the viscous material carried thereby.

7. The apparatus according to claim 5 in which the end walls, the upper wall, the base wall and the rear wall are insulated with the front wall being uninsulated where said spreader chain engages upon the outer surface of said front wall when said container is in the filling and transport position and is heated by the contents of said container as aforesaid.

8. The apparatus according to claim 6 in which the end walls, the upper wall, the base wall and the rear wall are insulated with the front wall being uninsulated where said spreader chain engages upon the outer surface of said front wall when said container is in the filling and transport position and is heated by the contents of said container as aforesaid.

9. The apparatus according to claim 1 in which said dispensing means includes a selectively adjustable main dispensing gate valve assembly extending transversely across said front wall and a selectively adjustable ribbon gate valve assembly also extending transversely across said front wall above and spaced and parallel to said main dispensing gate valve assembly, said spreader chain assembly being situated immediately below said gate valve assemblies when said container is in the filling and transport position, each of said gate valves being selectively movable transversely from a closed position to an open position and vice-versa, said main gate valve assembly being adjustable to control the volume of material passing therethrough, said ribbon gate valve assembly being adjustable to vary the spacing of the ribbons of material dispensed thereby as well as adjusting the volume thereof.

10. The apparatus according to claim 2 in which said dispensing means includes a selectively adjustable main dispensing gate valve assembly extending transversely across said front wall and a selectively adjustable ribbon gate valve assembly also extending transversely across said front wall spaced and parallel to said main dispensing gate valve assembly, said spreader chain assembly being situated immediately below said gate valve assembly when said container is in the filling and transport position, each of said gate valves being selectively movable from a closed position to an open position and vice-versa, said main gate valve assembly being adjustable to control the volume of material passing therethrough, said ribbon gate valve assembly being adjustable to vary the spacing of the ribbons of material dispensed thereby as well as adjusting the volume thereof.

11. The apparatus according to claim 3 in which said dispensing means includes a selectively adjustable main dispensing gate valve assembly extending transversely across said front wall and a selectively adjustable ribbon gate valve assembly also extending transversely across said front wall spaced and parallel to said main dispensing gate valve assembly, said spreader chain assembly being situated immediately below said gate valve assembly when said container is in the filling and transport position, each of said gate valves being selectively movable from a closed position to an open position and vice-versa, said main gate valve assembly being adjustable to control the volume of material passing therethrough, said ribbon gate valve assembly being adjustable to vary the spacing of the ribbons of material dispensed thereby as well as adjusting the volume thereof.

12. The apparatus according to claim 4 in which said dispensing means includes a selectively adjustable main dispensing gate valve assembly extending transversely across said front wall and a selectively adjustable ribbon gate valve assembly also extending transversely across said front wall spaced and parallel to said main dispensing gate valve assembly, said spreader chain assembly being situated immediately below said gate valve assembly when said container is in the filling and transport position, each of said gate valves being selectively movable from a closed position to an open position and vice-versa, said main gate assembly being adjustable to control the volume of material passing therethrough, said ribbon gate valve assembly being adjustable to vary the spacing of the ribbons of material dispensed thereby as well as adjusting the volume thereof.

13. The apparatus according to claim 5 in which said dispensing means includes a selectively adjustable main dispensing gate valve assembly extending transversely across said front wall and a selectively adjustable ribbon gate valve assembly also extending transversely across said front wall spaced and parallel to said main dispensing gate valve assembly, said spreader chain assembly being situated immediately below said gate valve assembly when said container is in the filling and transport position, each of said gate valves being selectively movable from a closed position to an open position and vice-versa, said main gate assembly being adjustable to control the volume of material passing therethrough, said ribbon gate valve assembly being adjustable to vary the spacing of the ribbons of material dispensed thereby as well as adjusting the volume thereof.

14. The apparatus according to claim 6 in which said dispensing means includes a selectively adjustable main dispensing gate valve assembly extending transversely across said front wall and a selectively adjustable ribbon gate valve assembly also extending transversely across said front wall spaced and parallel to said main dispensing gate valve assembly, said spreader chain assembly being situated immediately below said gate valve assembly when said container is in the filling and transport position, each of said gate valves being selectively movable from a closed position to an open position and vice-versa, said main gate assembly being adjustable to control the volume of material passing therethrough, said ribbon gate valve assembly being adjustable to vary the spacing of the ribbons of material dispensed thereby as well as adjusting the volume thereof.

15. The apparatus according to claim 7 in which said dispensing means includes a selectively adjustable main dispensing gate valve assembly extending transversely across said front wall and a selectively adjustable ribbon gate valve assembly also extending transversely across said front wall spaced and parallel to said main dispensing gate valve assembly, said spreader chain assembly being situated immediately below said gate valve assembly when said container is in the filling and transport position, each of said gate valves being selectively movable from a closed position to an open position and vice-versa, said main gate assembly being adjustable to control the volume of material passing therethrough, said ribbon gate valve assembly being adjustable to vary the spacing of the ribbons of material dispensed thereby as well as adjusting the volume thereof.

16. The apparatus according to claim 8 in which said dispensing means includes a selectively adjustable main dispensing gate valve assembly extending transversely across said front wall and a selectively adjustable ribbon gate valve assembly also extending transversely across said front wall spaced and parallel to said main dispensing gate valve assembly, said spreader chain assembly being situated immediately below said gate valve assembly when said container is in the filling and transport position, each of said gate valves being selectively movable from a closed position to an open position and vice-versa, said main gate assembly being adjustable to control the volume of material passing therethrough, said ribbon gate valve assembly being adjustable to vary the spacing of the ribbons of material dispensed thereby as well as adjusting the volume thereof.

17. The apparatus according to claim 9 in which said front wall is apertured, said gate valve assemblies each including an apertured inner gate valve plate and a similarly apertured outer gate valve plate spanning said apertures within said front wall, at least one adjustable and tightening bolt assembly extending through said plates and through elongated slots in said front wall whereby said plates may be selectively end shifted to open and close said gate valves by aligning or misaligning the apertures in said gate valve plates with the apertures in said front wall, and to adjust same as desired.

18. The apparatus according to claim 10 in which said front wall is apertured, said gate valve assemblies each including an apertured inner gate valve plate and a similarly apertured outer gate valve plate spanning said apertures within said front wall, at least one adjustable and tightening bolt assembly extending through said plates and through elongated slots in said front wall whereby said plates may be selectively end shifted to open and close said gate valves by aligning or misaligning the apertures in said gate valve plates with the apertures in said front wall, and to adjust same as desired.

19. The apparatus according to claim 11 in which said front wall is apertured, said gate valve assemblies each including an apertured inner gate valve plate and a similarly apertured outer gate valve plate spanning said apertures within said front wall, at least one adjustable and tightening bolt assembly extending through said plates and through elongated slots in said front wall whereby said plates may be selectively end shifted to open and close said gate valves by aligning or misaligning the apertures in said gate valve plates with the apertures in said front wall, and to adjust same as desired.

20. The apparatus according to claim 12 in which said front wall is apertured, said gate valve assemblies each including an apertured inner gate valve plate and a similarly apertured outer gate valve plate spanning said apertures within said front wall, at least one adjustable and tightening bolt assembly extending through said plates and through elongated slots in said front wall whereby said plates may be selectively end shifted to open and close said gate valves by aligning or misaligning the apertures in said gate valve plates with the apertures in said front wall, and to adjust same as desired.

21. The apparatus according to claim 13 in which said front wall is apertured, said gate valve assemblies each including an apertured inner gate valve plate and a similarly apertured outer gate valve plate spanning said apertures within said front wall, at least one adjustable and tightening bolt assembly extending through said plates and through elongated slots in said front wall whereby said plates may be selectively end shifted to open and close said gate valves by aligning or misaligning the apertures in said gate valve plates with the apertures in said front wall, and to adjust same as desired.

22. The apparatus according to claim 14 in which said front wall is apertured, said gate valve assemblies each including an apertured inner gate valve plate and a similarly apertured outer gate valve plate spanning said apertures within said front wall, at least one adjustable and tightening bolt assembly extending through said plates and through elongated slots in said front wall whereby said plates may be selectively end shifted to open and close said gate valves by aligning or misaligning the apertures in said gate valve plates with the apertures in said front wall, and to adjust same as desired.

23. The apparatus according to claim 15 in which said front wall is apertured, said gate valve assemblies each including an apertured inner gate valve plate and a similarly apertured outer gate valve plate spanning said apertures within said front wall, at least one adjustable and tightening bolt assembly extending through said plates and through elongated slots in said front wall whereby said plates may be selectively end shifted to open and close said gate valves by aligning or misaligning the apertures in said gate valve plates with the apertures in said front wall, and to adjust same as desired.

24. The apparatus according to claim 16 in which said front wall is apertured, said gate valve assemblies each including an apertured inner gate valve plate and a similarly apertured outer gate valve plate spanning said apertures within said front wall, at least one adjustable and tightening bolt assembly extending through said plates and through elongated slots in said front wall whereby said plates may be selectively end shifted to open and close said gate valves by aligning or misaligning the apertures in said gate valve plates with the apertures in said front wall, and to adjust same as desired.

* * * * *